US008079744B2

(12) United States Patent
Tsao et al.

(10) Patent No.: US 8,079,744 B2
(45) Date of Patent: Dec. 20, 2011

(54) ILLUMINATING BRICK

(75) Inventors: Chih-Chung Tsao, Miao-Li Hsien (TW); Shu-Hui Hsieh, Miao-Li Hsien (TW); Mei-Jiun Lin, Miao-Li Hsien (TW); Hung-Chih Yang, Miao-Li Hsien (TW); Ping-Yu Chen, Miao-Li Hsien (TW); Tse-An Lee, Miao-Li Hsien (TW)

(73) Assignee: Foxsemicon Integrated Technology, Inc, Chu-Nan, Miao-Li Hsien (TW)

( * ) Notice: Subject to any disclaimer, the term of this patent is extended or adjusted under 35 U.S.C. 154(b) by 0 days.

(21) Appl. No.: 12/135,863

(22) Filed: Jun. 9, 2008

(65) Prior Publication Data

US 2009/0091924 A1 Apr. 9, 2009

(30) Foreign Application Priority Data

Oct. 8, 2007 (CN) ..... 2007 1 0201952

(51) Int. Cl.
*F21V 7/04* (2006.01)

(52) U.S. Cl. ..... 362/613; 362/610; 362/612; 362/619; 362/620

(58) Field of Classification Search ..... 362/609–610, 362/612–613, 619–620, 153, 153.1
See application file for complete search history.

(56) References Cited

U.S. PATENT DOCUMENTS

| | | | | |
|---|---|---|---|---|
| 4,223,377 | A * | 9/1980 | Williams | 362/145 |
| 5,046,826 | A * | 9/1991 | Iwamoto et al. | 349/65 |
| 6,379,017 | B2 * | 4/2002 | Nakabayashi et al. | 349/63 |
| 6,879,354 | B1 * | 4/2005 | Sawayama et al. | 349/63 |
| 2004/0183774 | A1 * | 9/2004 | Manabe et al. | 345/102 |

FOREIGN PATENT DOCUMENTS

| | | |
|---|---|---|
| CN | 03257672.2 | 6/2004 |
| CN | 200320118765.2 | 12/2004 |
| CN | 2673988 Y | 1/2005 |
| CN | 1621737 A | 6/2005 |
| TW | 423550 | 2/2001 |
| TW | 566447 | 12/2003 |

* cited by examiner

*Primary Examiner* — Sandra L O Shea
*Assistant Examiner* — Meghan K Dunwiddie
(74) *Attorney, Agent, or Firm* — Altis Law Group, Inc.

(57) ABSTRACT

An illuminating brick includes a block and at least one light-emitting element mounted in the brick. The brick has a top face, a bottom face and a plurality of lateral side surfaces interconnecting the top and bottom faces. The at least one light-emitting element is engaged in and optically coupled to at least one of the bottom face and lateral side surfaces. The lateral side surfaces and the bottom face are configured for reflecting and directing light emitted from the at least a light-emitting element to exit through the top face.

13 Claims, 4 Drawing Sheets

ILLUMINATING BRICK

BACKGROUND

1. Field of the Invention

The present invention relates to an illuminating brick and particularly to an illuminating brick using LED components as light source.

2. Description of Related Art

Cast concrete paving components are often referred to as unit pavers when installed abutted or in quantity covering large areas and as stepping stones when installed in strings or individual to form a narrow pathway or walk way. The use of unit pavers and the stepping stones for covering soil or loose surface to provide walkways, pathways, floors or road surfaces is well known. Typically, unit pavers and stepping stones are designed have an attractive appearance as well as being functional. The most common unit pavers and stepping stones are constructed from cast concrete or pressure formed aggregates to provide a heavy weight, hard surface and durable paver or stepping stone, as needed. In addition to being functional, unit pavers and stepping stones are versatile and are typically available in various shapes, sizes, colors, textures and interlocking designs.

A lighting is often desirable for providing light on the paved surface. The most common method for lighting a surface is to use light fixtures, such as lamp posts, designed to cast light onto the surface for aesthetic and safety reasons. However, the light cast from a fixture may only illuminate a portion of the surface adjacent to the fixture and may not sufficiently illuminate the entire surface. Moreover, lighting fixtures may not be practical or desirable to be positioned adjacent to the paved surface to provide the needed light because of natural or man-made obstacles.

What is needed, therefore, is an illuminating brick, which has an improved dissipating structure to overcome the above mentioned disadvantages.

SUMMARY

An illuminating brick includes a block and at least one light-emitting element mounted in the brick. The brick has a top face, a bottom face and a plurality of lateral side surfaces interconnecting the top and bottom faces. The at least one light-emitting element is engaged in and optically coupled to at least one of the bottom face and lateral side surfaces. The lateral side surfaces and the bottom face are configured for reflecting and directing light emitted from the at least a light-emitting element to exit through the top face.

BRIEF DESCRIPTION OF THE DRAWINGS

Many aspects of the present illuminating brick can be better understood with reference to the following drawings. The components in the drawings are not necessarily drawn to scale, the emphasis instead being placed upon clearly illustrating the principles of the present illuminating brick. Moreover, in the drawings, like reference numerals designate corresponding parts throughout the several views.

DETAILED DESCRIPTION OF THE INVENTION

Figure 1:
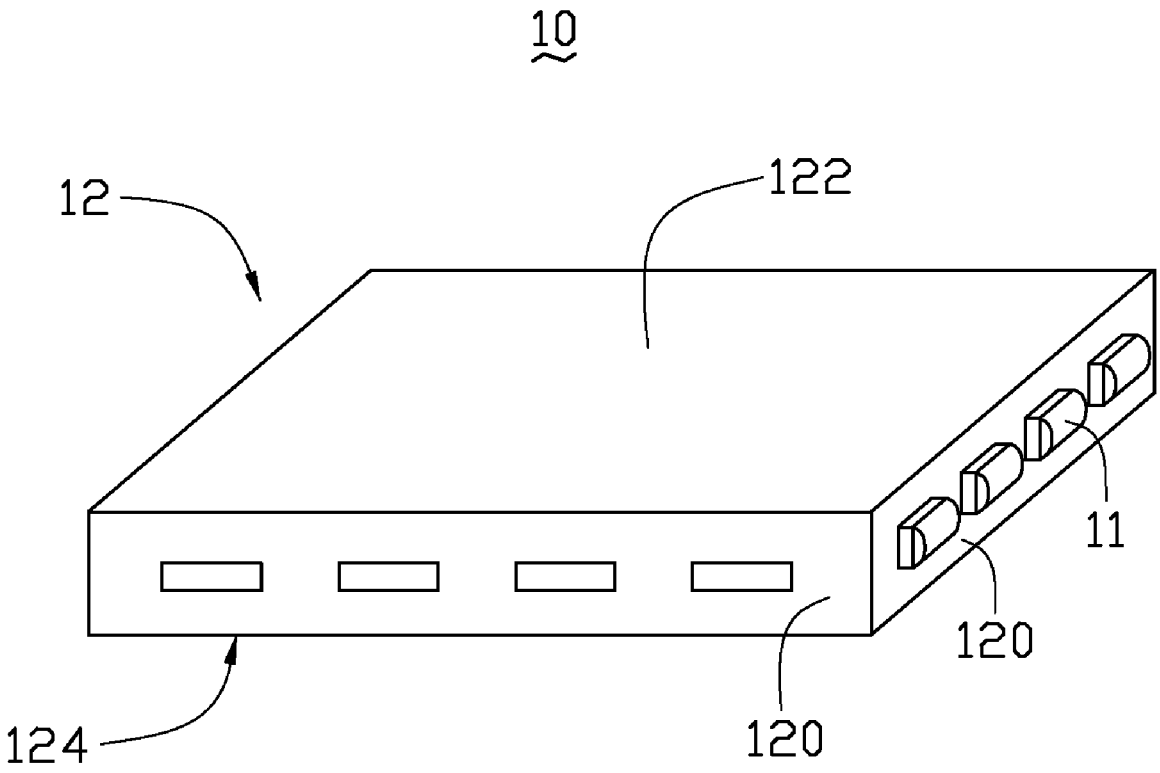
FIG. 1 is an isometric view of an illuminating brick in accordance with a first exemplary embodiment of the present invention.

Referring to FIG. 1, an illuminating brick 10 can be used as unit pavers, stepping stone, ceramic tile etc. and comprises a brick 12 and a plurality of LED components 11 as light sources embedded in the brick 12.

The brick 12 optically coupling with the LED components 11, is made of transparent material such as tempered glass, polymethylmethacrylate, poly carbonate and silicone etc. The brick 12 can be made in any variety of shapes and sizes. In the present embodiment, the brick 12 is cuboid-shaped and includes a top face 122, a bottom face 124 opposite to the top face 122, and four lateral sides 120. In the first exemplary embodiment, the bottom face 124 is configured for being disposed on a relatively flat surface such as graded soil. The LED components 11 are embedded in and optically coupled to at least one of the four lateral sides 120. Light emitted by the LED components 11 diffuses into the brick 12 through the corresponding lateral side 120 and is then internally reflected toward the top face 122 or directly travels through the top face 122 and reaches outside of the brick 12, whereby, light emitting by the LED components 11 is dispersed into outside area of the brick 12 through the top face 122 of the brick 12.

Figure 2:
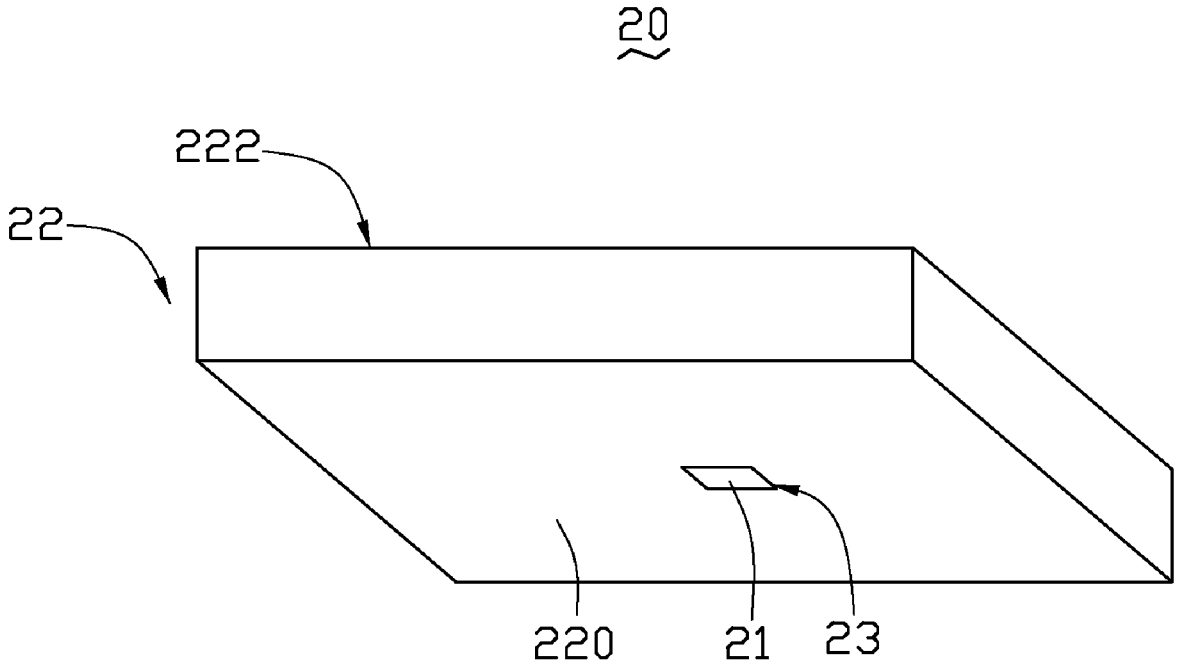
FIG. 2 is an isometric view of an illuminating brick in accordance with a second exemplary embodiment.
Figure 3:
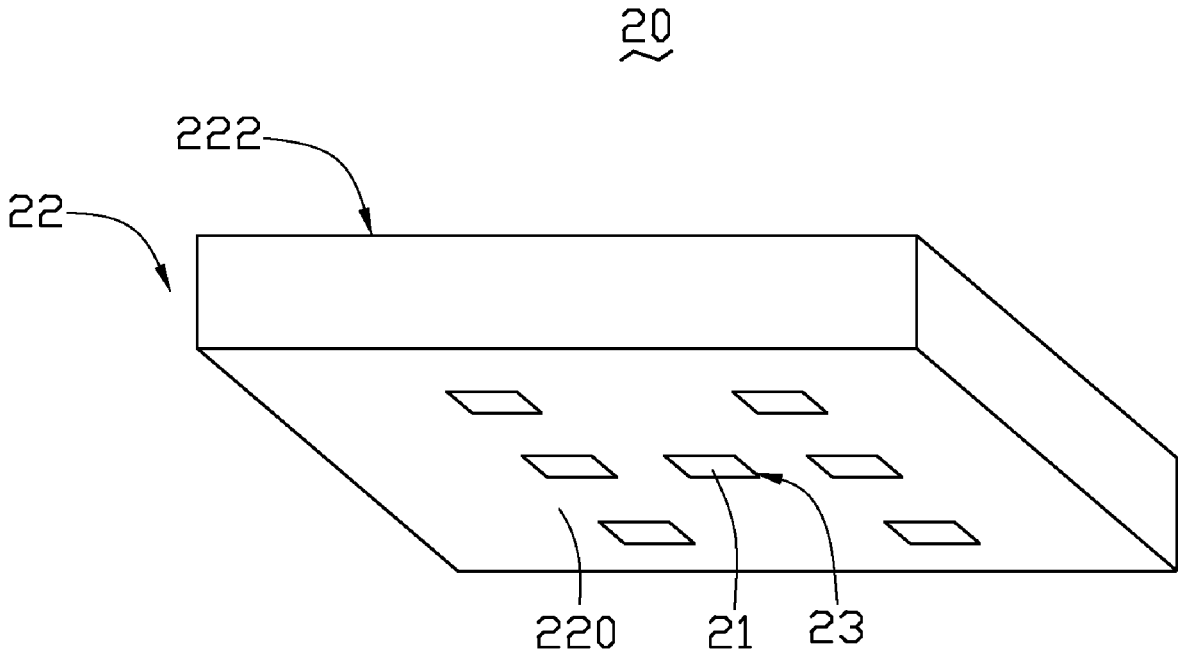
FIG. 3 is an isometric view of the illuminating brick of FIG. 2, with a plurality of LED components.

As shown in FIGS. 2 and 3, an illuminating brick 20 according to a second exemplary embodiment of the present invention, has a top face 222 as a light output surface and a bottom face 220 with at least one LED components 21 embedded and optically coupled therein. At least one recessed portion 23 is defined at the bottom surface 220 for receiving the at least one LED component 21 therein.

Figure 4:
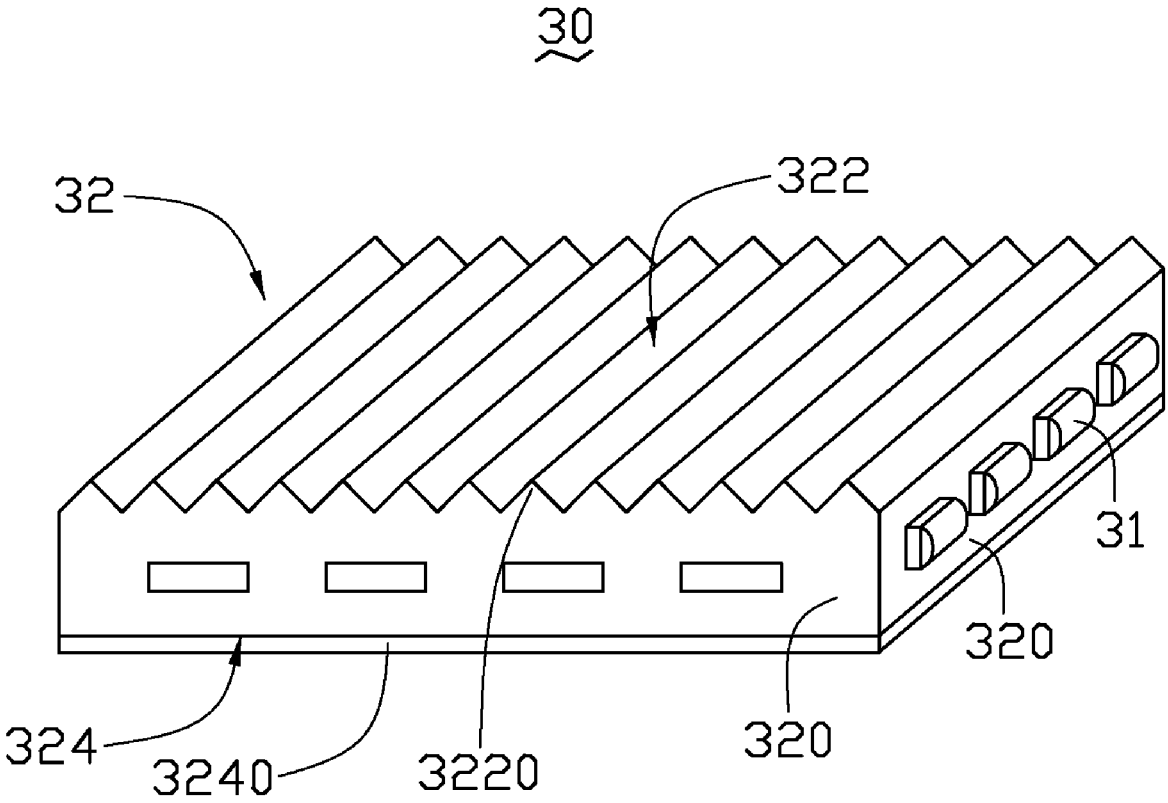
FIG. 4 is an isometric view of an illuminating brick in accordance with a third exemplary embodiment.

Referring to FIG. 4, an illuminating brick 30 according to a third exemplary embodiment of the present invention is illustrated. The illuminating brick 30 has a uniformly ridged surface 322 on a top end thereof, a bottom face 324 opposite to the surface 322, four lateral sides 320 and a plurality of LED components 31 embedded within and optically coupled to at least one of the lateral sides 320. The illuminating brick 30 is further provided with a reflecting film 3240 plated on the bottom face 324 for reflecting light emitted by the LED components 31 toward the surface 322, thereby enhancing illumination thereof.

The surface 322 is formed by a plurality of parallel and continuous V-shape grooves in a top flat face of the brick 32. The surface 322 is provided for restricting the path of light emitted by the surface 322 in a certain direction to create a desire light pattern. Additionally, the surface 322 can also act as a skid-resistant surface.

In addition, the LED components 11, 21, 31 of the embodiments may be of any available color, style, and functions as desired or needed.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An illuminating brick comprising:

a block having a top face, a bottom face and a plurality of lateral side surfaces interconnecting the top and bottom faces;

at least one first recess defined in the bottom face; and at least one first light-emitting element engaged in and optically coupled to the at least one first recess;

wherein the lateral side surfaces and the bottom face are configured for reflecting and directing light emitted from the at least one first light-emitting element to exit through the top face, and the brick is cuboid-shaped and the plurality of lateral side surfaces comprises four lateral side surfaces perpendicular to the bottom and top faces.

2. The illuminating brick of claim 1, wherein the at least one first light-emitting element is at least one LED component.

3. The illuminating brick of claim 2, wherein the at least one LED component emits visible colored light.

4. The illuminating brick of claim 1, wherein the brick is made of a material selected from the group consisting of tempered glass, polymethylmethacrylate, poly carbonate and silicone.

5. The illuminating brick of claim 1, wherein a grating is formed on the top face of the brick.

6. The illuminating brick of claim 5, wherein the grating includes a plurality of parallel grooves.

7. The illuminating brick of claim 6, wherein each of the grooves is V-shaped in cross section.

8. The illuminating brick of claim 1, wherein a reflecting film is provided on the bottom face of the brick.

9. An illuminating brick comprising:

a block having a top face, a bottom face and a plurality of lateral side surfaces interconnecting the top and bottom faces;

a plurality of recesses defined in the bottom face; and a plurality of LED components embedded in and optically coupled to the respective recess; wherein the lateral side surfaces and the bottom face are configured for reflecting and directing light emitted by the LED components to exit through the top face, and the brick is cuboid-shaped and the plurality of lateral side surfaces comprises four lateral side surfaces perpendicular to the bottom and top faces.

10. The illuminating brick of claim 9, wherein a grating is provided on the top face.

11. The illuminating brick of claim 10, wherein the grating includes a plurality of parallel V-shaped grooves in the top face.

12. The illuminating brick of claim 9, wherein a reflecting film is provided on the bottom face.

13. The illuminating brick of claim 1, further comprising at least one second recess defined in at least one of the lateral side surfaces, and at least one second light-emitting element engaged in and optically coupled to the at least one second recess.

* * * * *